US008818241B2

(12) United States Patent
Swartz et al.

(10) Patent No.: US 8,818,241 B2
(45) Date of Patent: Aug. 26, 2014

(54) UNIVERSAL PART FOR USE IN AN IMAGE RECORDING APPARATUS

(75) Inventors: William K Swartz, Sanford, NC (US); Donald R Huck, Sanford, NC (US); Lawrence Dale Lewis, Sanford, NC (US); Anthony D Causey, Fuquay Varina, NC (US)

(73) Assignee: Static Control Components, Inc., Sanford, NC (US)

( * ) Notice: Subject to any disclaimer, the term of this patent is extended or adjusted under 35 U.S.C. 154(b) by 221 days.

(21) Appl. No.: 13/230,359

(22) Filed: Sep. 12, 2011

(65) Prior Publication Data

US 2013/0064573 A1 Mar. 14, 2013

(51) Int. Cl.
*G03G 15/00* (2006.01)

(52) U.S. Cl.
USPC ..... 399/159; 399/109; 399/167

(58) Field of Classification Search
USPC ..... 399/109, 116, 117, 159, 167
See application file for complete search history.

(56) References Cited

U.S. PATENT DOCUMENTS

| | | | | | |
|---|---|---|---|---|---|
| 3,853,024 | A | * | 12/1974 | Vesci | 74/810.1 |
| 4,043,214 | A | * | 8/1977 | Westlake | 474/162 |
| 4,839,690 | A | * | 6/1989 | Onoda et al. | 399/117 |
| 5,023,660 | A | * | 6/1991 | Ebata et al. | 399/111 |
| 5,130,751 | A | * | 7/1992 | Sato et al. | 399/96 |
| 5,210,574 | A | * | 5/1993 | Kita | 399/117 |
| 5,402,207 | A | * | 3/1995 | Michlin | 399/117 |
| 5,436,699 | A | * | 7/1995 | Komaki | 399/159 |
| 5,461,464 | A | * | 10/1995 | Swain | 399/159 |
| 5,500,714 | A | * | 3/1996 | Yashiro et al. | 399/111 |
| 5,634,175 | A | * | 5/1997 | Michlin et al. | 399/90 |
| 5,729,792 | A | * | 3/1998 | Ikehara | 399/90 |
| 5,881,342 | A | * | 3/1999 | Makino et al. | 399/167 |
| 5,926,673 | A | | 7/1999 | Foster | |
| 5,927,370 | A | * | 7/1999 | Judkins | 160/291 |
| 5,943,527 | A | * | 8/1999 | Kashiwagi et al. | 399/90 |
| 6,023,596 | A | * | 2/2000 | Makino | 399/167 |
| 6,366,746 | B1 | * | 4/2002 | Sasago et al. | 399/90 |
| 6,490,426 | B1 | * | 12/2002 | Zaman | 399/117 |
| 6,771,915 | B2 | * | 8/2004 | Cais et al. | 399/90 |
| 7,050,736 | B2 | * | 5/2006 | Hale et al. | 399/90 |
| 7,133,637 | B2 | * | 11/2006 | Lee | 399/330 |
| 7,346,292 | B2 | * | 3/2008 | Williams et al. | 399/109 |
| 7,813,676 | B2 | | 10/2010 | Huck | |
| 2003/0223774 | A1 | * | 12/2003 | Himes et al. | 399/117 |
| 2006/0045568 | A1 | * | 3/2006 | Kishi et al. | 399/111 |
| 2006/0165436 | A1 | * | 7/2006 | Nishimura | 399/117 |
| 2006/0291923 | A1 | * | 12/2006 | Jang et al. | 399/333 |
| 2007/0025758 | A1 | * | 2/2007 | William et al. | 399/109 |
| 2007/0098468 | A1 | * | 5/2007 | Jang | 399/333 |
| 2009/0317734 | A1 | * | 12/2009 | Takeda | 430/60 |
| 2010/0067946 | A1 | * | 3/2010 | Zogg | 399/117 |

OTHER PUBLICATIONS

Japan Patent Pub. No. 2-7676, dated Jan. 18, 1990.*

* cited by examiner

*Primary Examiner* — David Bolduc

(57) ABSTRACT

A universal OPC drum that allows a remanufacturer to stock a minimum number of OPC drum sleeves of various sizes and then add the appropriate gear for the desired cartridge at the time of cartridge remanufacture. A universal OPC drum may also include a universal hub and an electrical contact on each end to maintain universality without regard to whether the OEM contact is mounted on the drive or non-drive side of the OPC drum.

20 Claims, 12 Drawing Sheets

UNIVERSAL PART FOR USE IN AN IMAGE RECORDING APPARATUS

BACKGROUND

The present application relates generally to remanufacturing toner cartridges, and more particularly to techniques for replacing a rotatable cylinder in the toner cartridge. One example of a rotating cylinder is a toner cartridge organic photo conductor drum (OPC drum).

The remanufacture of many different types of toner cartridge requires maintaining a large inventory composed of many different types rotating cylinders. Storing multiple rotating cylinders occupies storage space for the different sizes of cylinder, the gears, and hubs necessary in the cartridge remanufacture process. What is needed is a universal rotating cylinder adaptable for use in a large variety of cartridge types. Such a universal rotating cylinder would enable a remanufacturer to maintain an inventory of fewer cylinder types when manufacturing a variety of cartridges.

The present application provides multiple methods to assemble a universal OPC drum sleeve with a standard mounting end affixed to both sides and making a multitude of different OPC drums for use in various printers by interchanging the gears and/or unique features for the intended printer.

The method of design and installation of the gear and OPC drum interface will be discussed in the following embodiments. It is understood that the designs and explanations described in this document shall not be limiting to the overall concept and shall also include any or all extensions and variations of the following embodiments.

SUMMARY

In accordance with one aspect of the present application, a universal hub is mounted on both ends of a rotating cylinder, which enables a gear to be easily mounted to it and securely assembled in place.

In accordance with another aspect of the present application, a threaded member, separate fastener is employed to secure the hub and gear together. This may be accomplished by an internal outwards or external inwards fastener.

In accordance with another aspect of the present application, the hub and gear are bonded together using an adhesive or other form of bonding agent to join the two members.

These and other features and objects of the invention will be more fully understood from the following detailed description of the embodiments, which should be read in light of the accompanying drawings.

In this regard, before explaining at least one embodiment of the invention in detail, it is to be understood that the invention is not limited in its application to the details of construction and to the arrangements of the components set forth in the description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be used as a basis for designing other structures, methods, and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The accompanying drawings, which are incorporated in and form a part of the specification, illustrate embodiments of the present invention and, together with the description, serve to explain the principles of the invention.

DETAILED DESCRIPTION OF THE DRAWINGS

Figure 1:
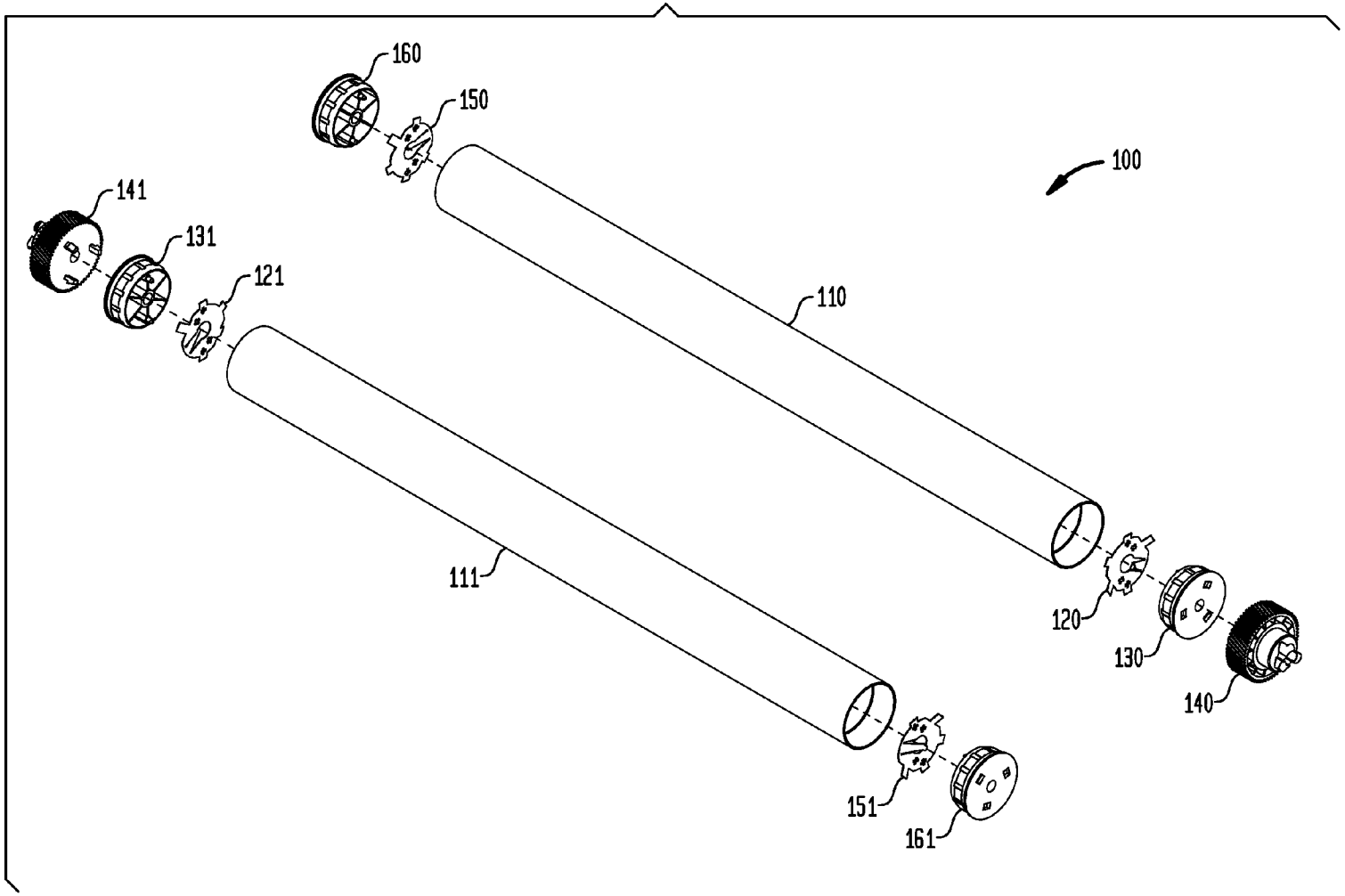
FIG. 1 shows a snap mechanism on gear installation on either end.

In describing an embodiment of the invention illustrated in the drawings, specific terminology will be used for the sake of clarity. However, the invention is not intended to be limited to the specific terms so selected, and it is to be understood that each specific term includes all technical equivalents which operate in a similar manner to accomplish a similar purpose.

FIG. 1 illustrates two views of an Organic Photo Connector drum assembly 100 also commonly referenced to, an OPC drum 110, 111. The OPC drum 110, 111 is a cylindrical metallic sleeve, typically comprised of aluminum and coated with various layers. The OPC drum serves as an image bearing member which is charged by the primary charge roller (PCR) and then discharged by a laser. The charge and discharge transfers toner from a developer roller to a laser created latent image on the drum via electrical fields, ending with the transfer of toner to a print media form such as paper.

In image recording devices, rotating cylinders rotate using gears. For example, the OPC 110, 111 drum rotates using a gear 140, 141 affixed to the cylindrical metallic sleeve. Electrical conductivity is achieved through a contact or 120, 121 mounted internal to the OPC drum. The contact connects to a pin or other conductive agent in the ink or toner cartridge enabling voltage to flow to the OPC drum. The voltage enables the OPC drum to receive the latent image to which the toner will adhere in the electrophotographic process. At least one contact is contained on each side of the drum with a contact 120 on the gear side 140 and another electrical connector 150, 151 on the gear side affixed to the non-gear side 160, 161.

In the laser printing process, each cartridge may have an OPC drum to absorb a latent image of the area to be printed to a media and later to be cleaned for reuse. The length of said OPC drum is typically one length for portrait type printing and a different length for landscape type printing. Other dimensions may also be employed. The diameter of the OPC drum 110, 111 is typically either 24 mm or 30 mm. Each cartridge or cartridge family may have a unique gear 140, 141 and/or hub 160, 161 with two drum contacts affixed at the hub on the gear side 140, 141 and at the non-gear end 160, 161. The OPC drum is an example of a rotating cylinder 110,111 used in a printer.

A remanufacturer must stock a multitude of different OPC drums in inventory to ensure that there is the correct OPC drum is available for each cartridge type that is being remanufactured. In this application, a minimum standard OPC drum sleeve, (24 mm & 30 mm diameter and a length of each for portrait & landscape printing) can be stocked. The gear and hub combination can then be stocked separately and assembled onto the desired OPC drum sleeve at the time of remanufacture.

In a first embodiment, the universal hub is mounted on both ends 140, 141 and 160, 161 of a rotating cylinder and contains either male or female features. The features permit a gear to be easily mounted to it and securely assembled in place. The method of interface may be in the form of a heat weld, snap mechanism, or other suitable methods.

Figure 2:
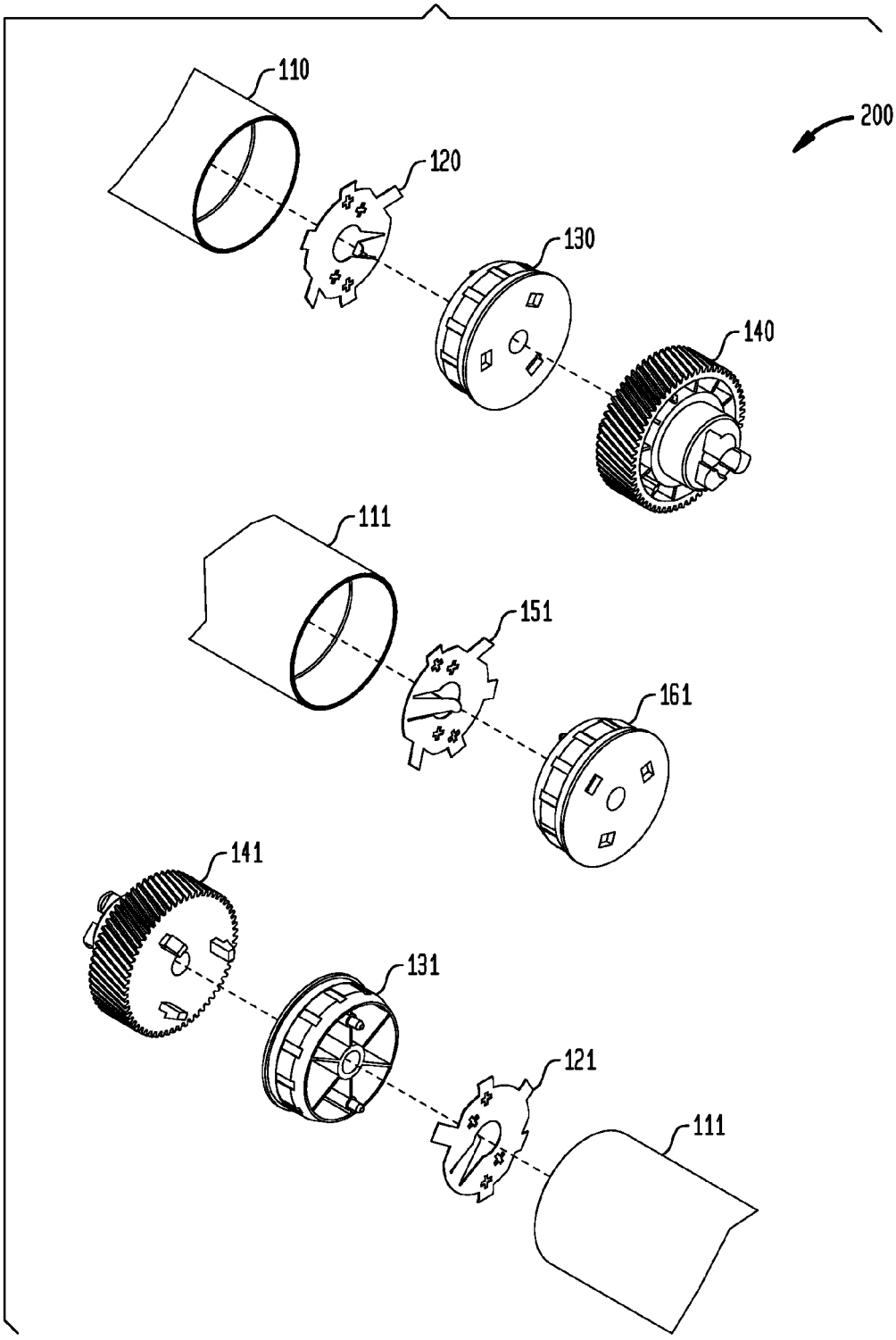
FIG. 2 shows detail of a snap mechanism on a gear.

FIG. 2 illustrates a snap mechanism on the gear 200. Here the drive gear 141 may attach to a hub 131 which then attaches to the electrical contact 121 which in turn is connected to the rotating cylinder. The opposite end of the rotating cylinder 111 would accommodate the contact side comprising an electrical connector 151 and the contact hub 161. The hub 131 and the drive gear 141 pieces may be held together through use of a least one snap portion which protrude from one piece and fit into at least one hole in the other piece. The components may be attached by placing the components together and applying pressure to push the pieces together. No cutting is required to install or remove the components from the OPC drum.

Figure 3:
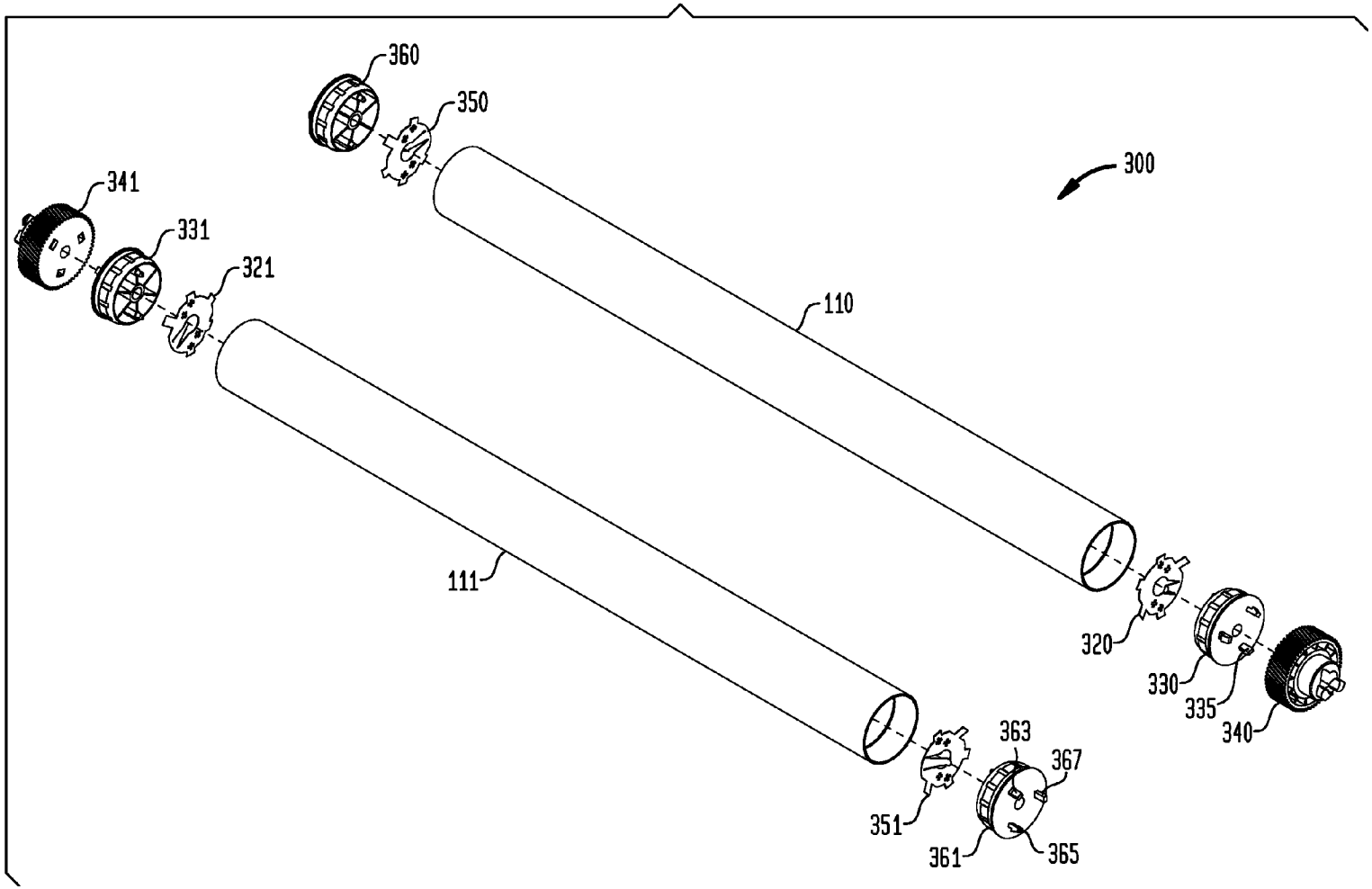
FIG. 3 shows a snap mechanism on a hub gear installation on either end.

FIG. 3 displays the snap mechanism 300 on the hub end 360, 361. Here the hub 360 fits over the electrical connector 350 and attaches into the end of the rotating cylinder 110. The opposite end of the rotating cylinder 110 contains the gear 340. An opposite view shows the hub 361 contains a plurality of cut off pins or snaps 363, 365, 367 that extend from the hub 361. This hub 361 may be mounted over the electrical connector 351 thus securing the electrical connector 351 to the inside of the rotating cylinder 111.

The gear installation 340 is fitted into the hub 330 by means of at least one mounting spike, tab, pins or snap 335. Attached to the opposite side of the hub 330 is the electrical connector 320 which is secured to the inside of the drum 110 when the hub 330 is attached to the end of the drum 110. An opposite view shows the gear 341 attached to the hub 331, where the opposite side of the hub 331 is attached to the electrical connector 321. The electrical connector 321 is secured into the rotating cylinder 111 by the attachment of the gear side 341 onto the end of the rotating cylinder 111.

Figure 4:
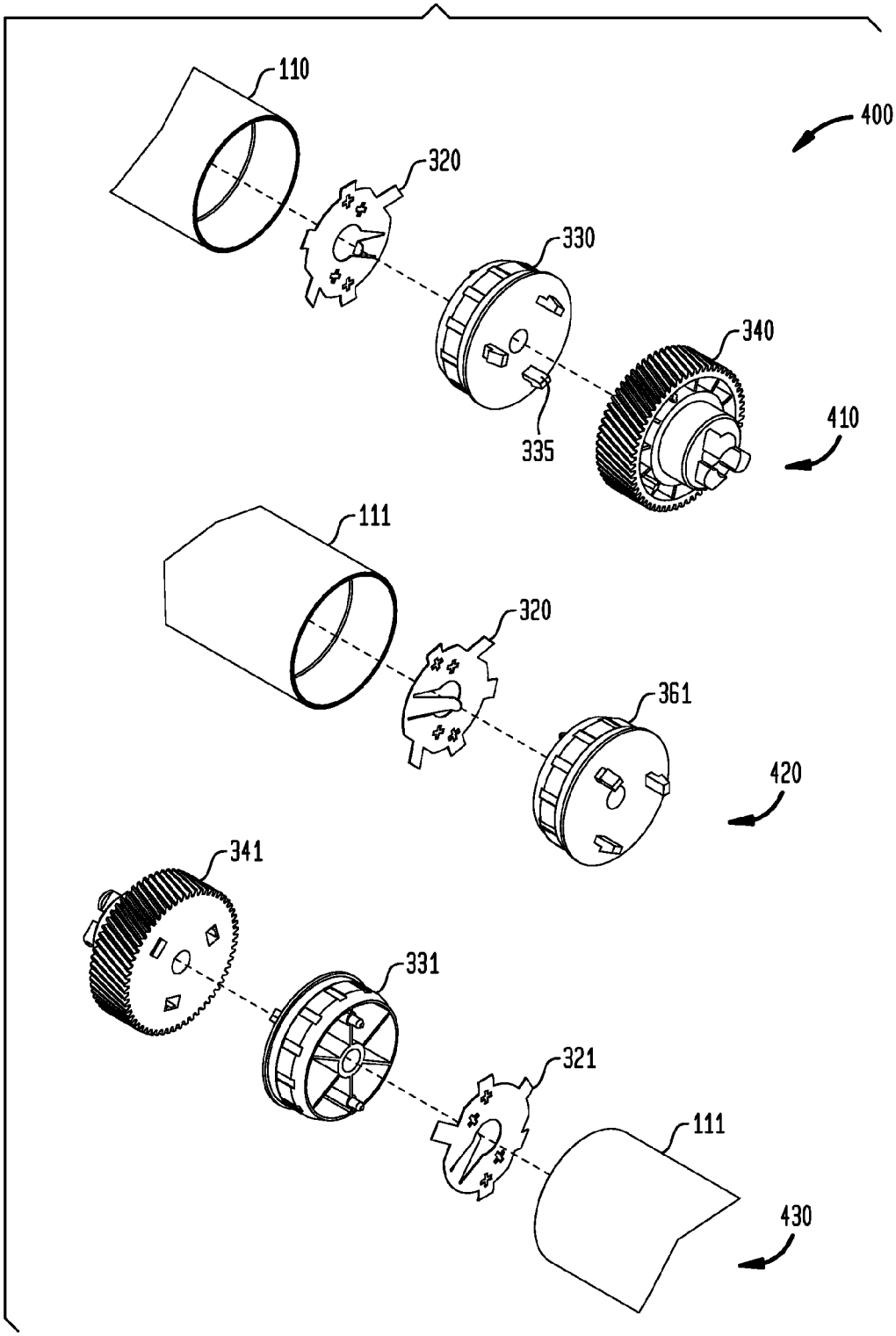
FIG. 4 shows detail of a snap mechanism on a hub.

FIG. 4 displays three separate views of the snap mechanism 400. A detailed view 410 of the gear end illustrates the gear 340 attached to the hub 330 next to the electrical connector 320 which is secured to the inside of the rotating cylinder 111 when the hub 330 is attached to the end of the rotating cylinder 111.

An opposite view 420 shows the hub 361 contains a plurality of cut off snaps 363, 365, 367 that extend from the hub 361. The snaps 363, 365, 367 may be removed from the hub 361 to facilitate mounting of the drum. This hub 361 may be mounted over the electrical connector 351 thus securing the electrical connector 351 to the inside of the rotating cylinder 111.

A closer view 430 of the drive end, the drive gear 341 is attached to the hub 331, where the opposite side of the hub 331 is attached to the electrical connector 321. The electrical connector 321 is secured into the rotating cylinder 111 by the attachment of the gear side 341 onto the end of the rotating cylinder 111.

Figure 5:
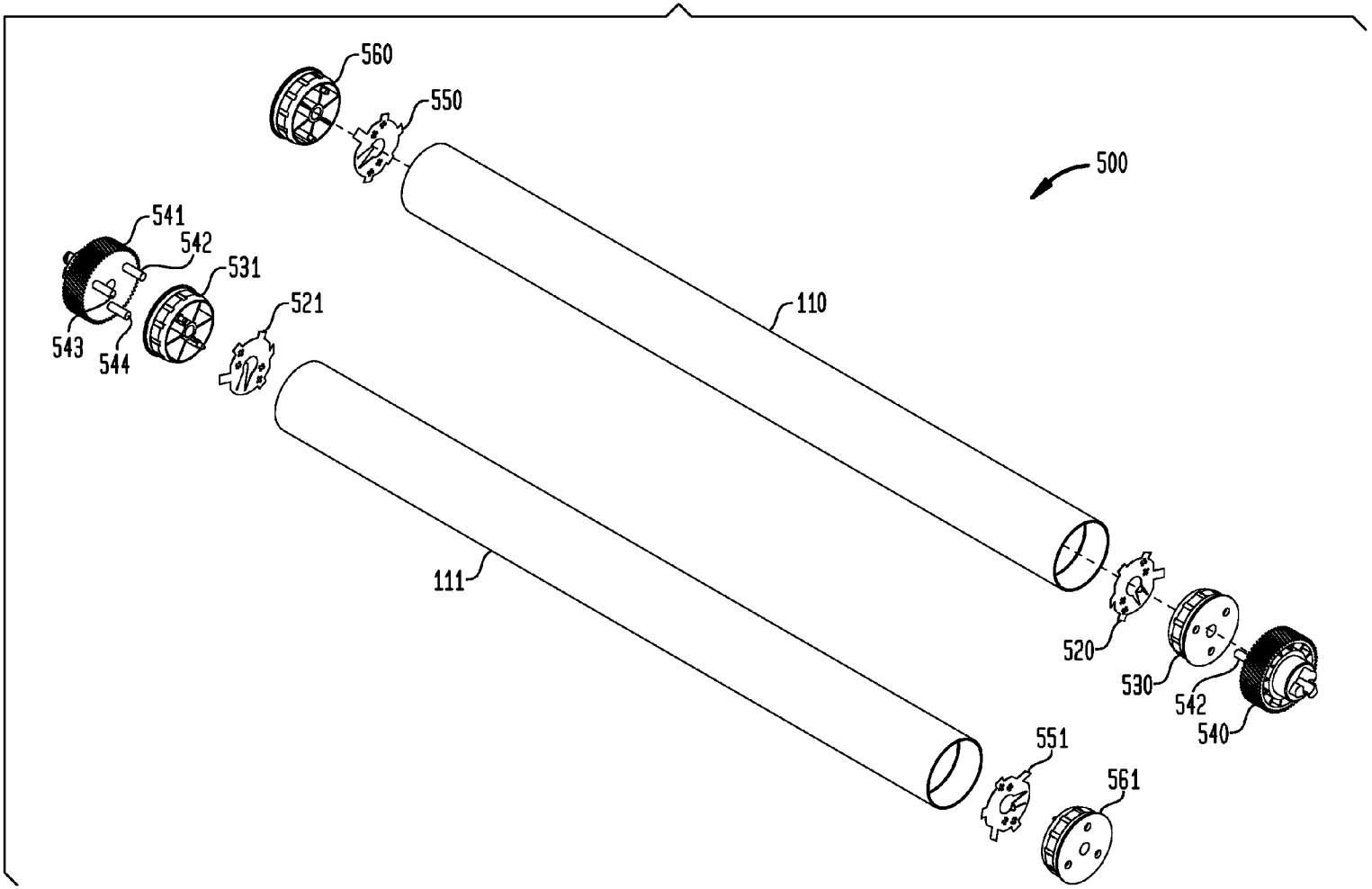
FIG. 5 shows a pin mechanism on gear installation on either end which does not require cutting.

FIG. 5 displays an embodiment where a pin mechanism is employed to fasten the gear onto either end 500 of the rotating cylinder 110, 111. A first end of the rotating cylinder 110 contains an electrical connector 520, 521, a hub 530, 531 and a gear 540, 541. The gear 540, 541 contains pins 542, 543, 544. The pins 542, 543, 544 contained on the hub 540 are not detached and no cutting is performed to detach the pins. The pins remain attached and serve to hold the gear to the hub 540. The opposite end containing an electrical connector 550, 551 and a hub 560, 561 may also contain pins, or alternately, may not contain pins.

Figure 6:
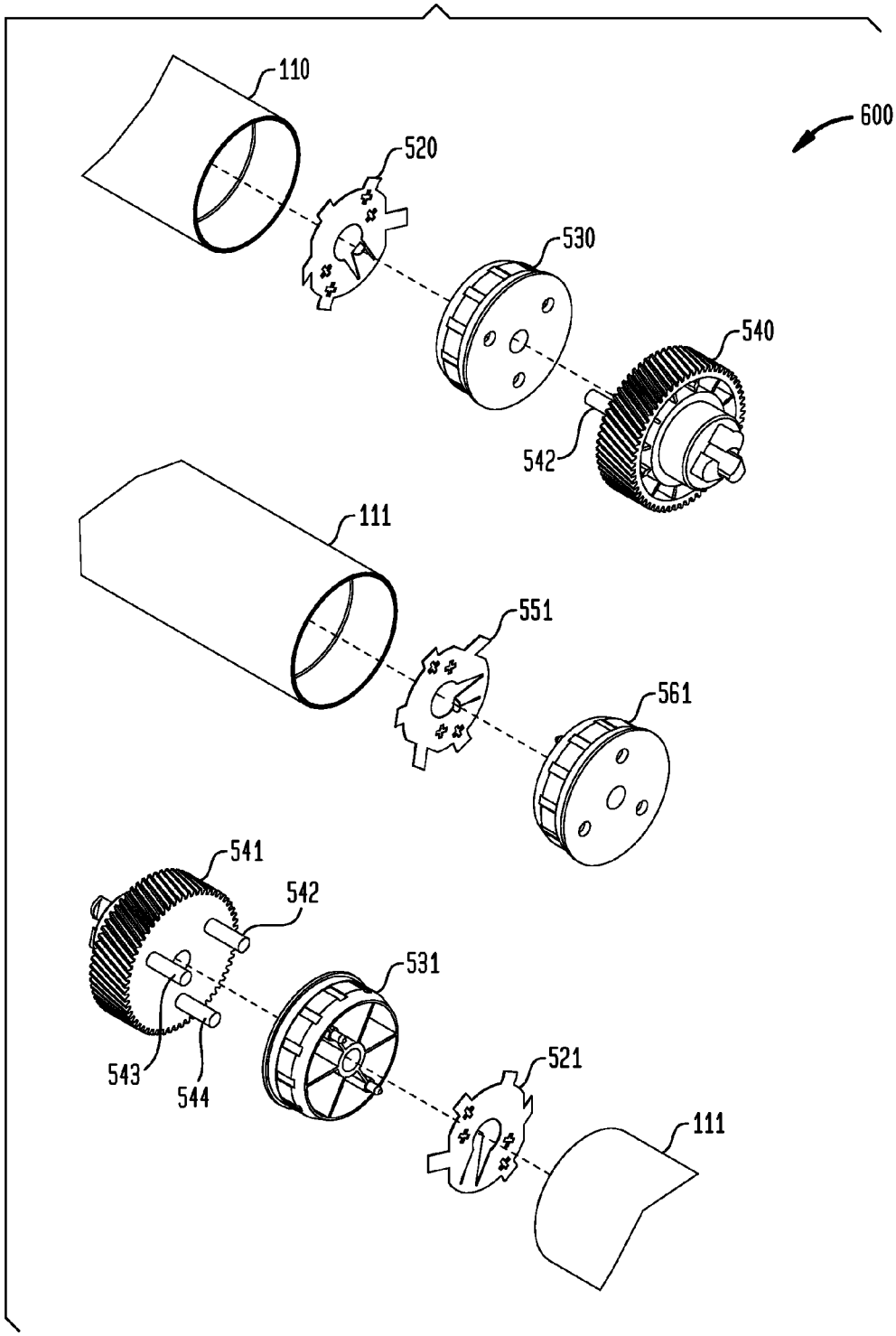
FIG. 6 shows detail of a pin mechanism on a gear.

FIG. 6 displays a more detailed view of the pin contained on the gear embodiment 600. The rotating cylinder 110,111 receives the electrical connector 520, 521, 550, 551 which is held in place by the hub 530, 531, 560, 561. The hub is attached to the gear 540, 541 which contains a plurality of pins 542, 543, 544 that are inserted into the gear 530 and hold the gear 540 to the hub 530. The hub 530 and the gear 540 are attached and remain attached when inserted into the end of the drum assembly 110.

Figure 7:
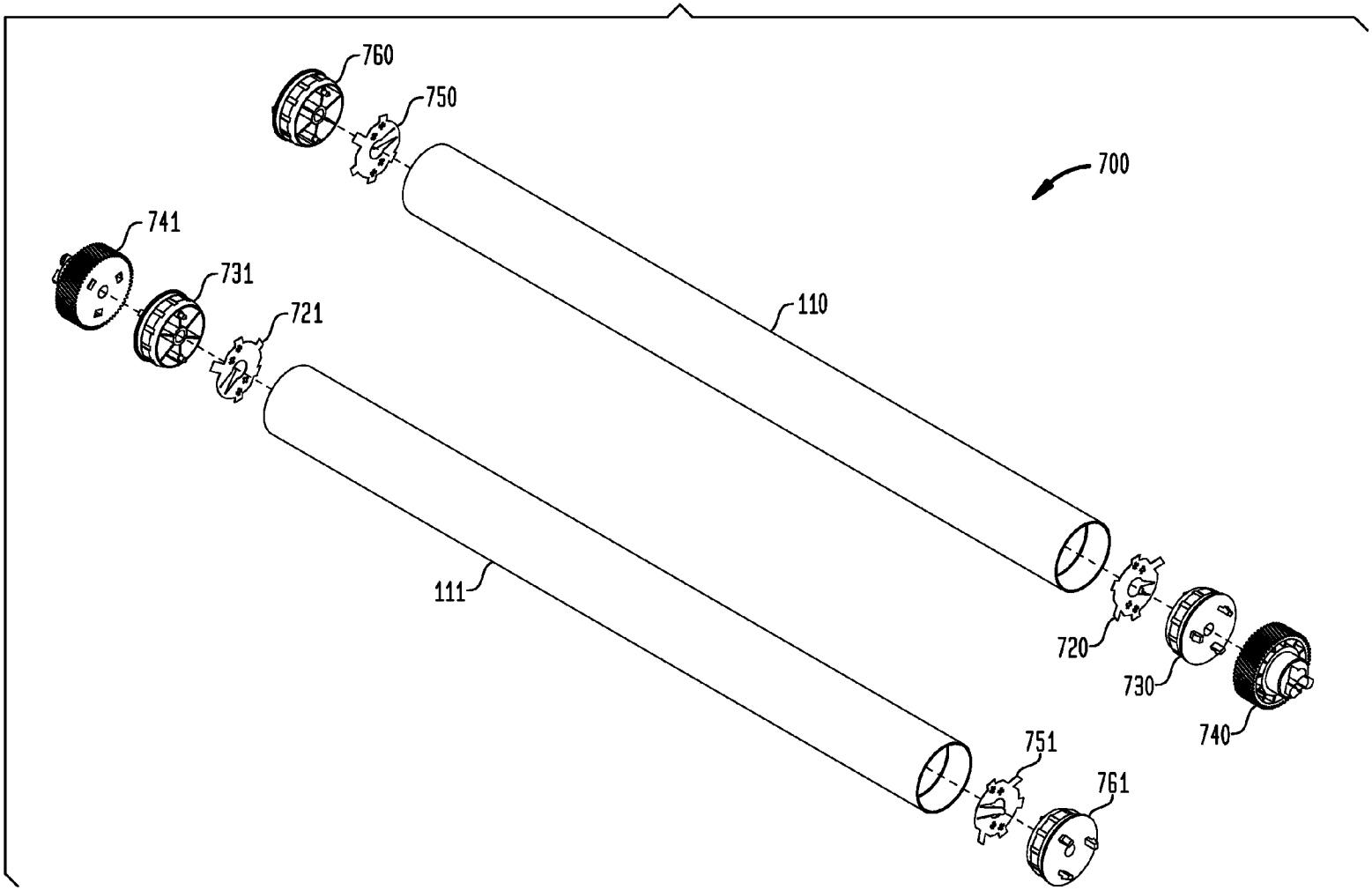
FIG. 7 shows a pin mechanism on a hub.

FIG. 7 displays another embodiment 700 where the pin mechanism is employed to fasten the gear installation on either end of the drum 110, 111. This embodiment 700 differs from the previous embodiment 600 in that the gear end 740 contains at least one hub 730, 731, or 760, 761 which contains a series of pins. Both hubs 730, 731 and 760, 761 may also contain such pins.

Figure 8:
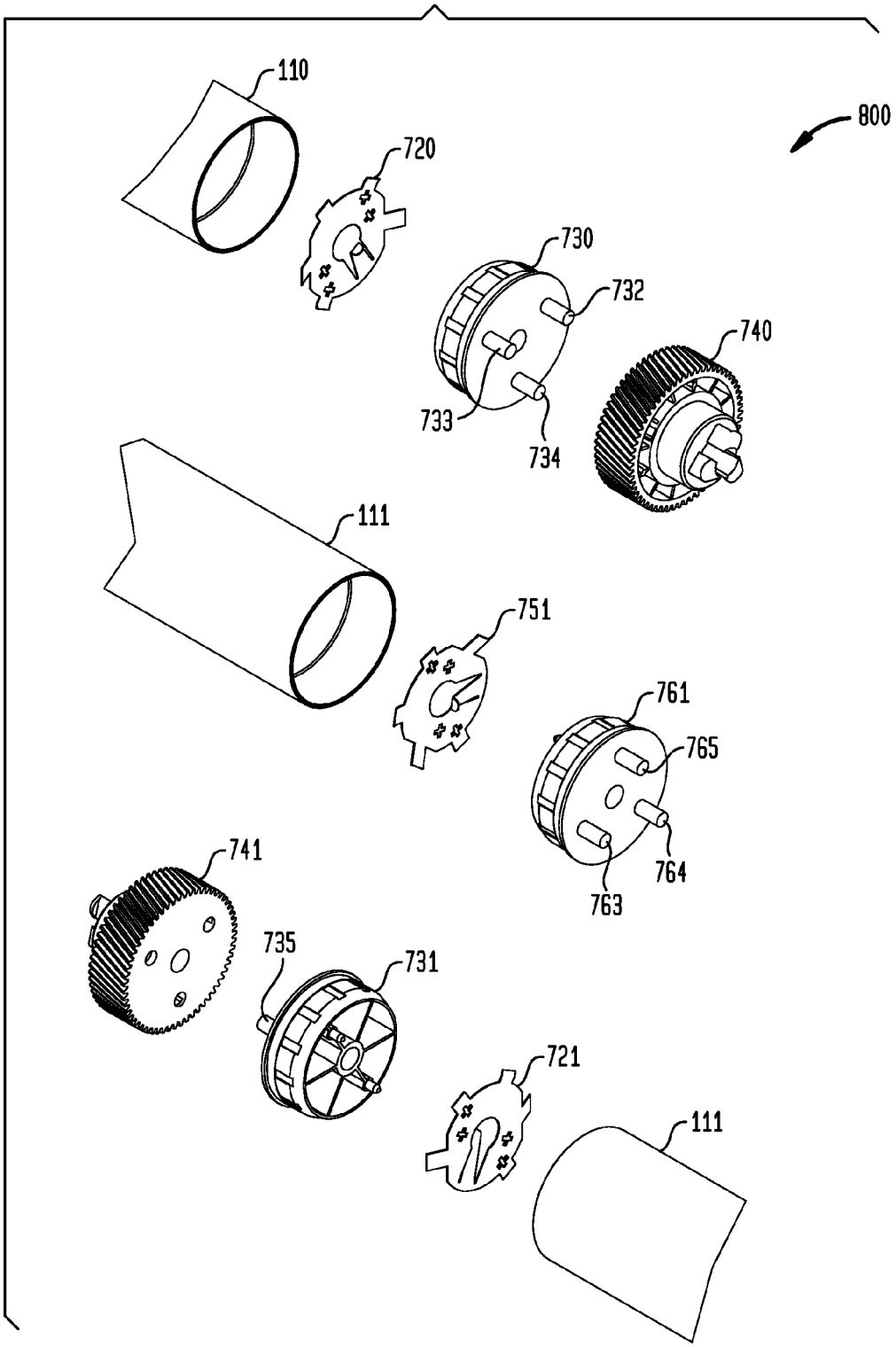
FIG. 8 shows detail of a pin mechanism on a hub.

FIG. 8 displays a more detailed view 800 of the pin mechanism on at least one of the hubs 730, 731 or 761. The hub 730 may be placed into the rotating cylinder 110 with a gear 740 placed at the end of the drum 110. The opposite end contains an electrical connector 751 and another hub 761. The rotating cylinder assembly 111 may also contain at least one hub 761 with the pins 763, 764, 765 removed before the hub 761 is placed over the electrical connector 751. The opposite end of the rotating cylinder 111 may also contain an electrical connector 721, a gear 741 and a hub 731 that has the pins either removed or remaining intact. In a preferred embodiment there is an electrical connector on both ends of the rotating cylinder. In an alternative embodiment there is an electrical connector 721 on only one end of the rotating cylinder. A one end electrical connector 721 may have the electrical connector 721 only on the gear end 740, 741. Alternatively, a single end electrical connector 751 may have the electrical connector only on the hub end 761. However, the preferred embodiment includes an electrical connector on both ends 720, 750 of the rotating cylinder 110, 111.

The drum 110, 111 may include hubs 730, 760 containing pins. A first end hub 730 may include pins 732, 733, 734. The pins enable the gear 740 to attach to the hub 730 prior to the hub 730 and gear 740 being placed over the electrical connector 720 and inserted onto the drum 110. The opposite end of the drum 111 may also include a hub 761 having a plurality of pins 763, 764, 765 that extend from the hub 761 that is placed over an electrical connector 751 when placed on the end of the drum 111. The hub 731 is shown with the pins 735 oriented toward the gear 741. The gear 741 and hub 731 are held together by the pins 735 when placed over the electrical connector 721 and onto the drum 111.

Figure 9:
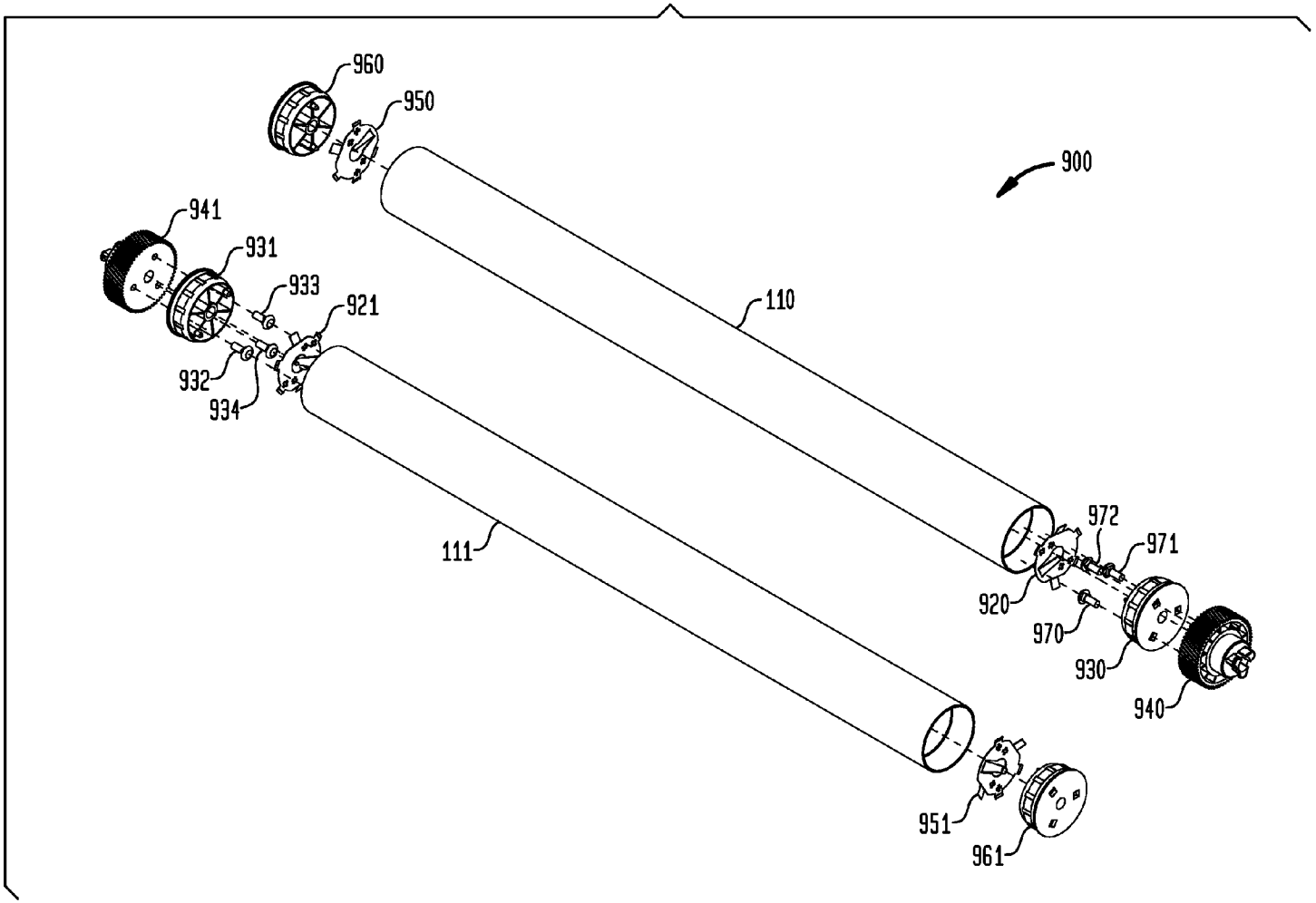
FIG. 9 shows a screw mechanism, internal gear installation which does not require cutting pins.

FIG. 9 displays a further embodiment which utilizes a threaded member, separate fastener, or other similar means of securing the hub and gear together 900. This can be accomplished either by utilizing the fastener internal outwards or external inwards. In the event of an internal fastener installed to fasten outwardly, a stove bolt type or similar locking feature may be used to keep the screw or fastener from being able to rotate. In this method, an unthreaded square, hexagon, or multisided feature is built into the fastener and installed into a similarly shaped feature in the mating part to keep said fastener in place during installation. A key and keyway design can perform the same function of locking the hub to the fastener or locking the hub directly to the gear.

At a first end of a drum 110 a plurality of screws 970, 971, 972 are placed through holes in a hub 930. The screws 970, 971, 972 are fastened into a gear 940 and hold the hub 930 securely to the gear 940. The screws 970, 971, 972 may be seated into the hub 931 such that the head of the screws 970, 971, 972 fit on the back side of the hub 931 facing away from the gear such that each screw 970, 971, 972 each fits behind a separate wedge shaped section of the back side of the hub. This assembly is placed onto an electrical connector 920 and inserted into the end of the drum. The opposite end of the drum contains an electrical connector 950 and a hub 960. An alternate view shows the screws 932, 933, 934 passing through holes in the hub 931 and attaching into the gear 941. This affixed the hub 931 to the gear 941 and enables the assembly to be placed over the electrical connector 921 and onto the drum 111.

In the preferred embodiment, the screws would not intersect into or come in contact with into the electrical connector 1121. However, an embodiment may be implemented wherein the screws do pass through holes in the electrical contact 921, 951. In another embodiment the screws intersect with or come in to connect with the electrical contact 921, 951.

Figure 10:
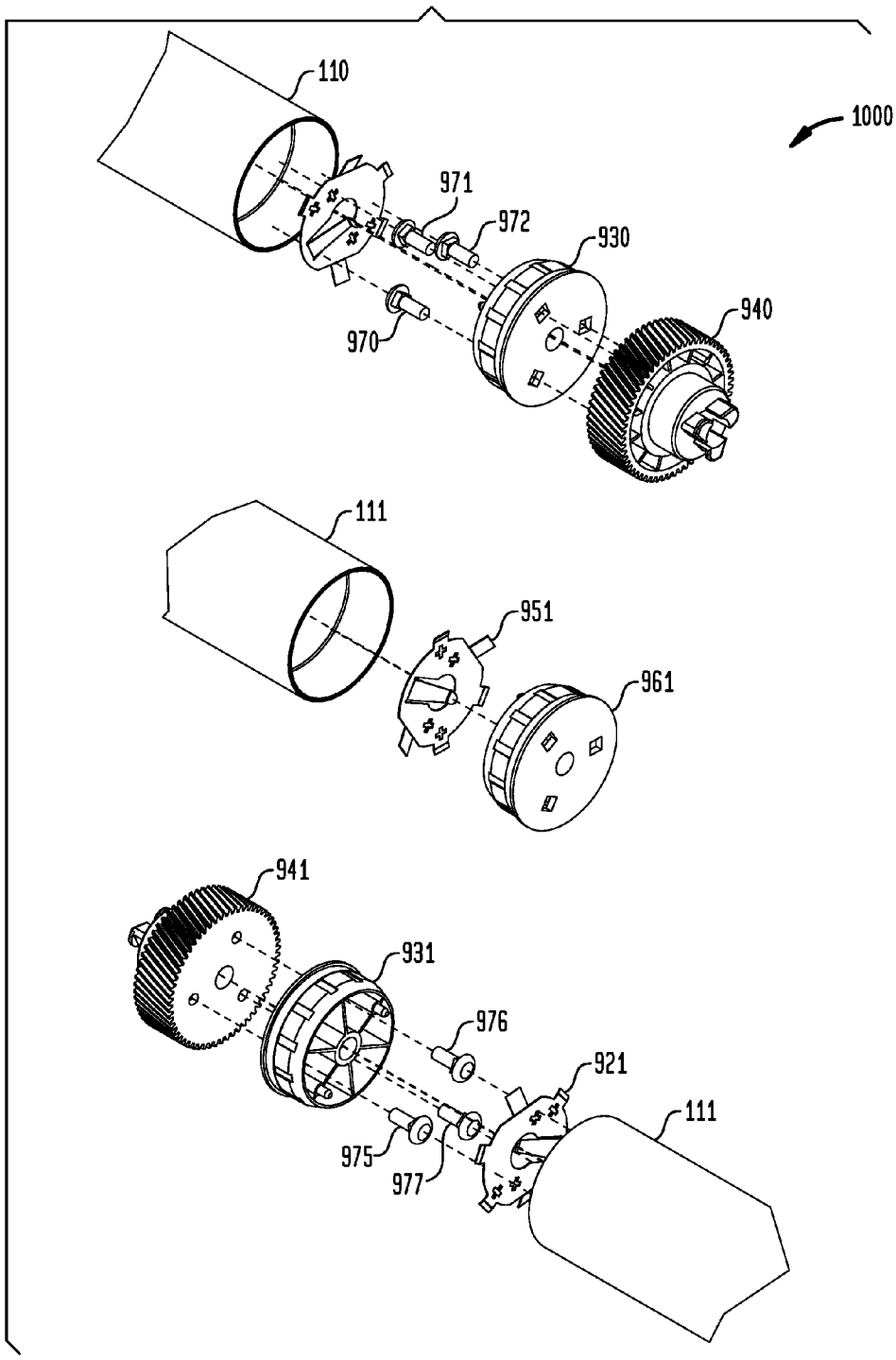
FIG. 10 shows detail of an internal screw attachment mechanism.

FIG. 10 displays a closer view of the drum 110 and use of screws 971, 972, 973 with the electrical connector located next to but not attached by the screws 971, 972, 973. The screws 971, 972, 973 may be made of metal that conducts an electrical charge or of a material that insulates against flow of an electrical charge such as plastic or ceramic. The screws may also contain non-helical threads such as bolts or other threaded or non-threaded fasteners. The screws 971, 972, 973 may be inserted through non-threaded holes located in the hub 930. Alternately, the holes may be threaded such that the screw threads may be inserted into the threaded holes. Alternately, the holes within the hub may comprise sides of the holes that may be made of a soft material that allows the screw threads to be embedded in the hub hole material driven through the material by the force of being turned. After the screws 971, 972, 973 pass through the hub 930, the screws may then be embedded into the drive gear 940 by fitting into a pre-drilled hole of any particular shape, or by being embedded into the drive gear material driven through the material by the force of being turned. The opposite end of the drum 111 may also contain similar screws. The opposite end of the drum 111 may also not contain screws. The opposite end of the drum 111 may only contain an electrical connector 951 and a hub 961 inserted onto that end of the drum 111. Another detailed view of the drum 111 with the screws 975, 976, 977 passing through holes in the hub 931 and attaching to the gear 941, with the assembly placed over the electrical connector 921 and onto the end of the drum 111.

While a preferred embodiment includes an electrical connector on both ends of the drum 110, 111, an alternative embodiment may have an electrical connector 971 on only one end. Such a one end electrical connector may contain the electrical connector 971 only on the gear end 940. Such a one end electrical connector 951 may also contain the electrical connector only on the hub end 961.

Figure 11:
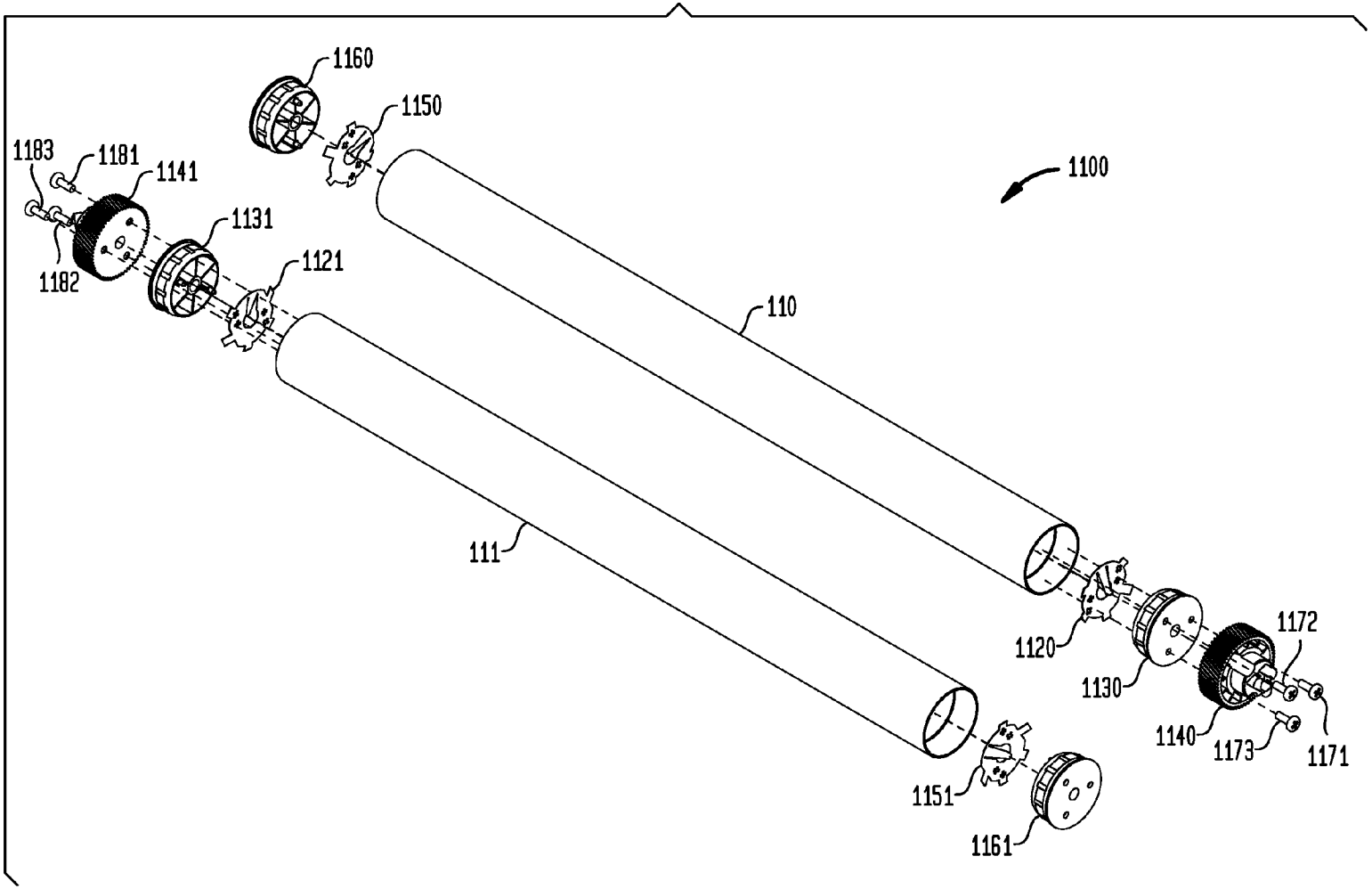
FIG. 11 shows a screw mechanism of an external gear installation on either end which does not require cutting pins.

FIG. 11 displays an embodiment of the screw mechanism for the external gear 1140 installation, where the screws pass through the electrical connector 1100. At a first end of a cylinder 110, a plurality of screws 1171, 1172, 1173 pass through holes in a gear 1140, through holes in a hub 1130 and through an electrical connector 1120 to attach the gear 1140, the hub 1130 and the electrical connector 1120 together. The screws 1171, 1172, 1173 may also attach the gear 1140, hub 1130 and electrical connector 1120 to the cylinder. The opposite end may contain an electrical connector 1150 and a hub 1160 that are attached to the cylinder 110 without use of any screws. The cylinder 111 may be installed in the opposite direction, with the screws 1181, 1182, 1183 passing through holes in the gear 1141, in the hub 1131. In the preferred embodiment, the screws would not intersect or come into contact with the electrical connector 1121. In an alternative embodiment the screws pass through holes in the electrical contact 921, 951. In another alternative embodiment, the screws intersect with or come into connect with the electrical contact 921, 951. The screws 1171, 1172, 1173 may be made of metal or any material that conducts electricity or may be made of a plastic, ceramic or other material that does not conduct electricity.

Figure 12:
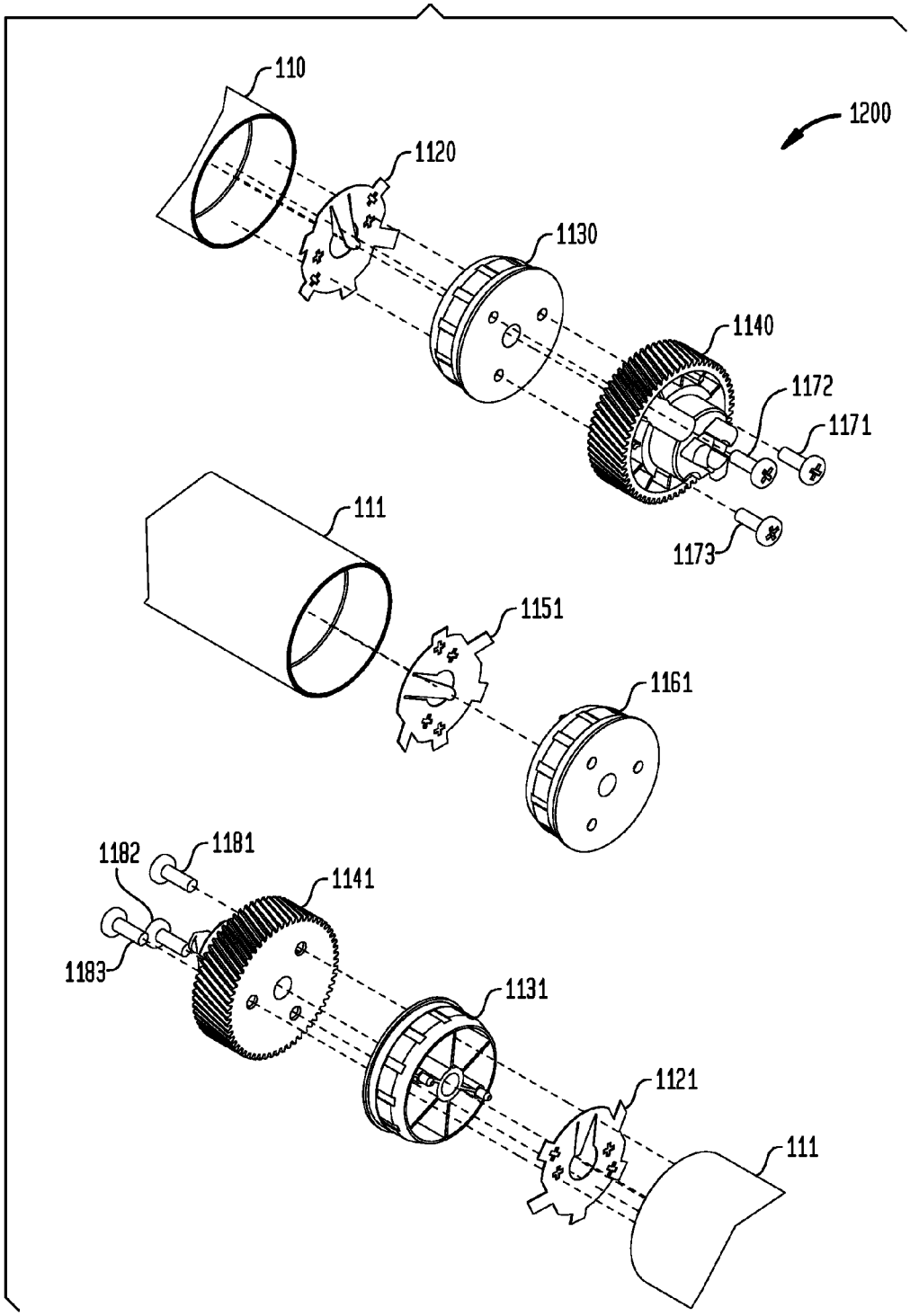
FIG. 12 shows detail of an external screw mechanism.

FIG. 12 displays a closer view of the screw mechanism 1200. The cylinder 110 may be connected to the electrical connector 1120, to the hub 1130 and the gear 1140 by a plurality of screws 1171, 1172, 1173. The opposite end of the cylinder 111 contains an electrical connector 1151 and a hub 1161 that are not connected by screws. The opposite end of the cylinder 111 may also be connected to the electrical connector 1121, the hub 1131, and the gear 1141 by a plurality of screws 1181, 1182, 1183 that pass through holes in the gear 1141 and holes in the hub 1131 and may or may not pass through holes in the electrical connector 1121.

In an alternative embodiment, instead of utilizing a mechanical means to join the universal hub to the gear end, the universal hub is bonded to the gear end using an adhesive or other form of bonding agent to join the two members. A male and female interface feature or multiple features may also be used in order to ensure proper alignment of the gear to the rotating cylinder during assembly.

In many of the embodiments, a universal hub is assembled to both ends of the rotating cylinder sleeve. This universal sleeve would typically be equipped with an electrically conductive contact assembled to it prior to installation into the rotating cylinder such that the rotating cylinder is fully reversible and the location of the drum pin for electrical conductivity may be mounted on either side of the cartridge without negative impact in functionality.

Although the embodiments describe having a universal hub on an OPC drum, the universal hub can be used with any components that have gear structure on one or both ends. For example, printers typically have a mag roller and one or both ends of the mag roller could have a universal hub to allow the mag roller to be used in different model printers.

Additionally, the embodiments describe remanufacturing a print cartridge using a rotating cylinder having a universal hub. Alternatively, a new OPC drum can be made using the universal hub. This may be an OPC drum designed for use in a new cartridge or a new OPC drum used to refurbish a previously used cartridge.

The many features and advantages of the invention are apparent from the detailed specification. Thus, the appended claims are intended to cover all such features and advantages of the invention which fall within the true spirits and scope of the invention. Further, since numerous modifications and variations will readily occur to those skilled in the art, it is not desired to limit the invention to the exact construction and operation illustrated and described. Accordingly, all appropriate modifications and equivalents may be included within the scope of the invention.

Although this invention has been illustrated by reference to specific embodiments, it will be apparent to those skilled in the art that various changes and modifications may be made which clearly fall within the scope of the invention. The invention is intended to be protected broadly within the spirit and scope of the appended claims.

What is claimed is:

1. A method of assembling a rotating cylinder used in an image recording device comprising: attaching a first electrical connector to a first hub, wherein the first hub is a universal hub configured to receive a first gear or a second gear to be attached to the first hub; wherein the first gear is configured to operate in a first image recording device, and wherein the second gear is configured to operate in a second image recording device different from the first image recording device; attaching the first gear or the second gear to the first hub; attaching the first electrical connector, the first hub and the first gear or the second gear to a first end of a printer drum sleeve; attaching a second electrical connector to a second hub, wherein the second hub is a universal hub is configured to receive the first gear or the second gear to be attached to the second hub; and attaching the second electrical connector and the second hub to a second end of the printer drum sleeve.

2. The method of claim 1, wherein at least one hub of the first hub and the second hub contains at least one snap protruding perpendicular from the at least one hub and directed parallel to the lateral axis of the printer drum sleeve.

3. The method of claim 2, wherein the at least one snap is removed from the first hub.

4. The method of claim 2, wherein the at least one snap is removed from the second hub.

5. The method of claim 1, wherein the first gear or the second gear contains snaps protruding perpendicular to the first gear or the second gear and directed parallel to the lateral axis of the printer drum sleeve.

6. The method of claim 5, wherein the snaps are removed from the first gear or the second gear.

7. The method of claim 1, wherein the first hub and the first gear or the second gear are snapped together.

8. The method of claim 1 further comprising:

placing at least one screw into a hole within the first hub such that the point on each screw is pointed away from the printer drum sleeve and toward the gear; and tightening the screws into the first gear or the second gear.

9. The method of claim 8, wherein the first gear or the second gear contains a pre-drilled opening which the end of the at least one screw may be inserted into and tightened.

10. The method of claim 1 further comprising:

placing at least one screw into a hole within the first gear or the second gear such that a point on the at least one screw is pointed toward the printer drum sleeve;

placing the at least one screw through a hole within the hub; and tightening the at least one screw into the electrical connector.

11. The method of claim 1, wherein the rotating cylinder is a universal organic photo conductor drum.

12. A universal organic photo conductor drum sleeve comprising: a hollow drum sleeve comprising a first end and a second end; a first electrical connector inserted into the first end of the hollow drum sleeve; a first hub placed over the first end of the hollow drum sleeve, wherein the first hub is a universal hub configured to receive a first gear or a second gear to be attached to the first hub; wherein the first gear is configured to operate in a first image recording device, and wherein the second gear is configured to operate in a second image recording device different from the first image recording device; the first gear or the second gear being attached to the first hub; a second electrical connector inserted into the second end of the hollow drum sleeve; and a second hub placed over the second end of the hollow drum sleeve, wherein the second hub is a universal hub is configured to receive the first gear or the second gear to be attached to the second hub.

13. The universal organic photo conductor drum sleeve of claim 12, wherein at least one hub of the first hub and the second hub contains snaps protruding perpendicular from the at least one hub in a direction parallel to the lateral axis of the hollow drum sleeve.

14. The universal organic photo conductor drum sleeve of claim 13, wherein the snaps are removed from the at least one hub.

15. The universal organic photo conductor drum sleeve assembly of claim 12, wherein the first gear or the second gear contains snaps protruding perpendicular to the first gear or the second gear and directed parallel to the lateral axis of the hollow drum sleeve.

16. The universal organic photo conductor drum sleeve of claim 15, wherein the snaps are removed from the first gear or the second gear.

17. The universal organic photo conductor drum sleeve of claim 12 further comprising:

at least one screw located in a hole within the first hub, wherein a point on the at least one screw is pointed away from the hollow drum sleeve and toward the first gear or the second gear.

18. The universal organic photo conductor drum sleeve of claim 12 further comprising:

at least one screw located in a hole within the first gear or the second gear such that a point of the at least one screw is pointed toward the hollow drum sleeve.

19. A universal organic photo conductor drum sleeve assembly comprising:

a drum sleeve comprising a first end and a second end; a first electrical connector inserted into the first end of the drum sleeve; a first hub placed over the first end of the drum sleeve, wherein the first hub is a universal hub configured to receive a first gear or a second gear to be attached to the first hub; wherein the first gear is configured to operate in a first image recording device, and wherein the second gear is configured to operate in a second image recording device different from the first image recording device; a second electrical connector inserted into the second end of the drum sleeve; a second hub placed over the second end of the drum sleeve, wherein the second hub is a universal hub configured to receive the first gear or the second gear to be attached to the second hub; the first gear or the second gear attached to the first hub by at least one of a snap, screw, or fastener and oriented perpendicular to a surface of the first hub and lengthwise parallel to a lateral axis of the drum sleeve.

20. The universal organic photo conductor drum sleeve assembly of claim 19 wherein the first hub is attached to the first gear or the second gear by an adhesive material.

* * * * *